United States Patent [19]

Keiter

[11] 4,119,384

[45] Oct. 10, 1978

[54] TYPING DEVICE INCLUDING A TYPE DISC

[75] Inventor: Alfred Keiter, Wilhelmshaven, Fed. Rep. of Germany

[73] Assignee: Olympia Werke AG, Wilhelmshaven, Fed. Rep. of Germany

[21] Appl. No.: 856,735

[22] Filed: Dec. 1, 1977

[30] Foreign Application Priority Data

Dec. 22, 1976 [DE] Fed. Rep. of Germany ..... 2658123

[51] Int. Cl.[2] ..... B41J 1/30

[52] U.S. Cl. ..... 400/144.2; 101/93.03; 400/166

[58] Field of Search ..... 101/93.03, 93.15–93.17, 101/93.19, 93.48; 400/144.2–144.4, 166, 157.3

[56] References Cited

U.S. PATENT DOCUMENTS

| | | | |
|---|---|---|---|
| 3,366,213 | 1/1968 | Craft et al. | 400/166 |
| 3,442,365 | 5/1969 | Ragland et al. | 400/144.3 |
| 3,677,387 | 7/1972 | Herterich et al. | 400/144.3 |
| 3,858,509 | 1/1975 | Grundherr | 400/144.2 X |
| 3,983,985 | 10/1976 | Guerrini et al. | 400/144.2 |

OTHER PUBLICATIONS

I.B.M. Tech. Disc. Bulletin, R. D. Mathews, "Printer Impact Control", vol. 18, No. 11, Apr. 1976, pp. 3533–3534.

I.B.M. Tech. Disc. Bulletin, J. E. Drejza, "Print Impression Control Device", vol. 19, No. 2, Jul. 1976, pp. 443–444.

*Primary Examiner*—Paul T. Sewell

*Attorney, Agent, or Firm*—Spencer & Kaye

[57] ABSTRACT

A typing device has a type disc which includes a plurality of bars each carrying a character and which is rotatable about an axis through predetermined angles for successively setting selected characters in a printing position. The typing device further has a hammer for impacting the bar of the selected character for pressing the selected character against a record carrier supported by a platen. The type disc carries a plurality of stops; each stop is assigned to a different character. The stops are arranged at least at two different distances from the disc axis, dependent upon the printing surface area of the associated character. The typing device further has an elastic lever, one end of which is movable into an abutting engagement with the stop of the associated character situated in the printing position. Another end of the elastic lever is connected to the hammer so that the hammer and the elastic lever are moved simultaneously by a hammer drive. The elastic lever is arranged to absorb, upon engagement with the respective stop, one part of the kinetic energy imparted by the hammer drive for reducing the force with which the character is pressed against the record carrier. The amount of the absorbed kinetic energy is a function of the distance of the respective stop from the disc axis.

5 Claims, 4 Drawing Figures

TYPING DEVICE INCLUDING A TYPE DISC

BACKGROUND OF THE INVENTION

This invention relates to a typing device including a type disc having a plurality of different characters, each carried at the end of separate elastic bars forming part of the type disc. The type disc is rotatable and is arrested in its rotation at a predetermined position in which the desired character selected to be printed is in alignment with a hammer device which also forms part of the typing device. Upon actuating of a drive mechanism, the hammer is caused to hit the aligned bar of the desired character, thus pressing the latter against a record carrier supported on a platen.

In a known typing device of the above-outlined kind, as disclosed, for example, in U.S. Pat. No. 3,677,387, an electromagnet is de-energized by a signal, allowing a pivotal arm secured to the armature of the electromagnet to swing under the effect of a tension spring. The hammer secured at the end of the pivotal arm is thus moved rapidly against the respective elastic bar of the type disc. As a result, the desired character which, with its bar, has been brought into alignment with the hammer into the printing position, is pressed onto the record carrier held by the platen. This kind of typing device does not admit the control of the impact force of the hammer.

In power-driven typing devices having a single type disc, it is, because of the different printing surface areas of the different characters, highly desirable to control the impact force for the purpose of rendering the imprint uniform.

SUMMARY OF THE INVENTION

It is an object of the invention to provide an improved typing device in which the impact energy is variable in a simple and inexpensive manner to thus adapt the impact force to the printing surface area of the individual characters.

This object and others to become apparent as the specification progresses, are accomplished by the invention, according to which, briefly stated, the type disc carries a plurality of stops; each stop is assigned to a different character. The stops are arranged at least at two different distances from the disc axis, dependent upon the printing surface area of the associated character. The typing device further has an elastic lever, one end of which is movable into an abutting engagement with the stop of the associated character situated in the printing position. Another end of the elastic lever is connected to the hammer so that the hammer and the elastic lever are moved simultaneously by a hammer drive. The elastic lever is arranged to absorb, upon engagement with the respective stop, one part of the kinetic energy imparted by the hammer drive for reducing the force with which the character is pressed against the record carrier. The amount of the absorbed kinetic energy is a function of the distance of the respective stop from the disc axis.

It is thus feasible to obtain, with simple and inexpensive means, a high-quality and uniform imprint in a typing device including a type disc, since, by virtue of causing the elastic lever to absorb, by resilient bending deformation, one part of the kinetic energy upon abutting the respective stop, each character is pressed against the record carrier with an impact force that is a function of the printing surface area of the respective individual characters. The above-outlined energy control according to the invention for equalizing the imprint involves no time delay, since the sensing of the respective stop on the type disc by the elastic bar and the printing motion of the hammer are effected simultaneously because of the continuous coupling between the hammer and the elastic bar.

DESCRIPTION OF THE PREFERRED EMBODIMENTS

Figure 1:
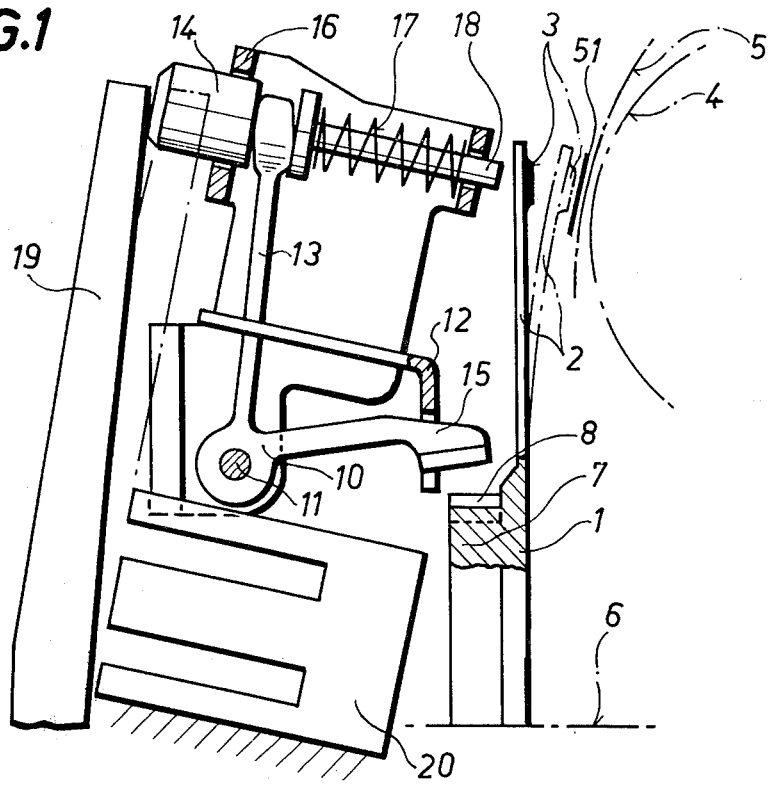
FIG. 1 is a side elevational view of a preferred embodiment of the invention.

Turning now to FIG. 1, the typing device shown therein has a type disc 1 which has a hub 7 and a plurality of resilient bars 2 secured at one end to the hub 7 and extending radially outwardly therefrom. The individual resilient bars 2 are formed, for example, from an initially continuous disc subsequently provided with radial slots. At the outer end of each elastic bar 2 there is secured a character 3. Adjacent the type disc 1 there is arranged a platen 4 to receive a record carrier 5 and an ink ribbon 51. The type disc 1 is rotatable about a rotational axis 6 by a drive motor (not shown).

Figure 2:
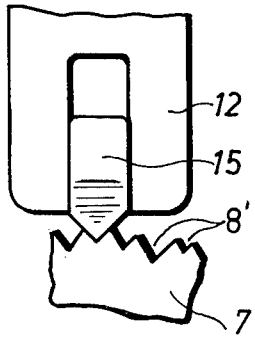
FIGS. 2 and 3 are front elevational views of two variants of a detail of the structure shown in FIG. 1.
Figure 3:
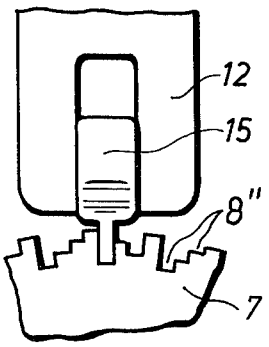

On the hub 7 there are provided a plurality of stops 8 arranged in a circumferential series axially adjacent the bars 2. With each stop 8 there is associated a separate character 3. The stops 8 are, dependent upon the printing surface area of the associated character 3 at different distances from the rotary axis 6 of the type disc 1. The stops 8 may have different designs. Thus, as shown in FIG. 2, the stops 8 are constituted by tooth gaps 8′ defined by adjoining ratchet teeth. The gaps 8′ are of different depth dependent upon the printing surface area of the associated character 3. According to the variant shown in FIG. 3, the stops 8 are formed by radial steps 8″ which, again, dependent upon the printing surface area of the particular character with which they are associated, have bases located at different distances from the rotary axis 6.

The height position of the individual stops 8 is sensed by an elastic lever 10 which is pivotally supported on a shaft 11 attached to the machine frame and is guided in a stationary fork 12. The lever 10 has two arms 13 and 15. With the free end of the arm 13 there is continuously coupled a hammer 14, while the free end of the arm 15 cooperates with a selected stop 8. At least one of the arms 13 and 15 of the lever 10 is capable of being elastically bent during operation, as will be discussed below. The hammer 14 is displaceably supported in a bracket 16 and is biased into its withdrawn position by the force of a spring 17. The left-hand terminus (as viewed in FIG. 1) of the hammer 14 cooperates with the armature 19 of an electromagnet 20 which functions as the drive of the hammer 14. When the hammer 14 is actuated, its right-hand, pin-like terminus 18 hits the aligned bar 2 of the arrested type disc 1 and presses the character 3 attached to that bar 2 against the ink ribbon 51 held in the traveling path of the character 3 adjacent the record carrier 5 which, in turn, is supported on the platen 4.

In the description which follows, the operation of the above-described typing device will be set forth.

The type disc 1 is rotated and then arrested when it reaches a predetermined angular position in which the character 3 to be printed is in the printing position, that is, it is in alignment with the traveling path of the hammer 14, 18. Thereafter, for initiating the printing of the selected character 3, the solenoid 20 is energized, causing the armature 19 to be attracted thereto. During this motion, the armature 19 hits and propels forward the hammer 14 towards the aligned bar 2. It is noted that the hammer 14 needs to be accelerated only during one part of its entire stroke; it can travel the remainder of that stroke by virtue of its kinetic energy without being positively driven by the armature 19. Simultaneously with this displacement of the hammer 14, the lever 10 which is permanently coupled to the hammer 14, is pivoted clockwise about its shaft 11 until the free terminus of the arm 15 of the lever 10 abuts against the stop 8 which is aligned with the traveling path of the arm 15 and which is associated with the character 3 to be printed. Upon further motion of the hammer 14, at least one of the arms 13 or 15 of the elastic lever 10 is resiliently bent; in this manner one part of the full kinetic energy imparted by the armature 19 to the hammer 14 is absorbed.

The effective abutting face of a stop 8 associated with a character 3 having a relatively small printing surface area is at a greater radial distance from the rotary axis 6 than the effective abutting face of a stop 8 associated with a character 3 having a relatively large printing surface area. As a result of this arrangement, the characters having a relatively small printing surface area are imprinted with a relatively small energy, since the arm 15, during the printing motion, abuts the respective stop 8 at a relatively early moment and thus the elastic lever 10 undergoes a bending deformation of relatively large extent. In contradistinction, in case of a character having a relatively large printing surface area, the arm 15, during the printing motion, arrives into engagement with the associated stop 8 at a relatively later moment so that the elastic lever 10 is bent relatively less, or is not bent at all. Thus, in the former case a greater proportion of the kinetic energy is absorbed by the elastic lever 10 than in the latter case. Consequently, the end result is that the force with which a character 3 is pressed against the ink ribbon 51 is a direct function of printing surface area of the character. In this simple manner, the kinetic energy imparted to the hammer 14 by the force exerting drive means 19, 20 is, by virtue of the varying spring effect of the elastic lever 10, regulated as a function of the printing surface area of the character to be printed. As a result, a uniform printing of all the characters is achieved.

Upon termination of the printing of a character, the electromagnet 20 is de-energized, whereby the spring 17 returns the hammer 14, the lever 10 and the armature 19 into their respective postion of rest. Thereafter, the type disc 1 may be set to print the successive character.

Figure 4:
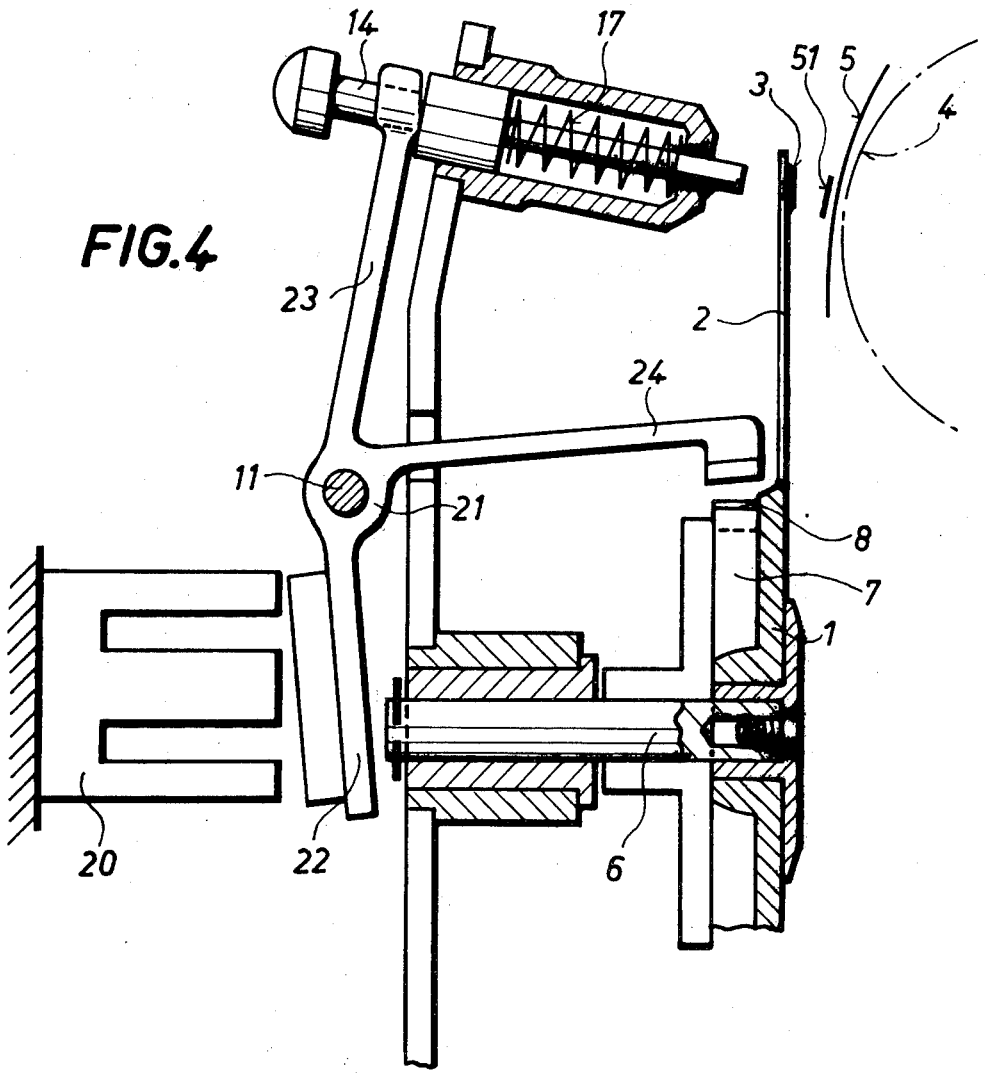
FIG. 4 is a side elevational view of another preferred embodiment of the invention.

Turning now to FIG. 4, there is illustrated another preferred embodiment of the invention. This embodiment includes an elastic three-arm lever 21, the first arm 24 of which cooperates with the stops 8, while its second arm 23 is continuously coupled with the hammer 14 and its third arm 22 constitutes the armature of the electromagnet 20. In this embodiment too, at least one of the arms 22, 23 and 24 of the lever 21 is capable of being bent elastically during operation, similarly to the lever 10 of the first-described embodiment. The elastic lever 21, upon sensing the height position of the stops 8, assumes different angular positions dependent upon the distance of the stops 8 from the rotary axis 6. In this manner, the energy imparted to the lever 21 by the electromagnet 20 is reduced already at the armature 22, so that the lever 21 is moved with different speeds into its work position and thus transmits one part of its energy to the hammer 14 as a function of the printing surface area of the character to be printed. In this embodiment too, the hammer 14 needs to be accelerated only through one part of its entire stroke, because it is coupled with the lever 21 for relative forward movement with respect thereto and thus is capable to execute the remainder of the stroke by its own kinetic energy. Thus, again, a varying abutment control and a uniform imprint of all characters is ensured.

In both embodiments described above, it is of particular advantage that the energy control for equalizing the imprint does not involve time delays because the printing motion of the hammer and the sensing motion of the elastic lever are executed simultaneously. Further, since the stops are fixed parts of the type disc, a replacement of the latter means an automatic replacement of the stops as well. Thus, when characters or character styles are changed by exchanging one type disc for another, the typing device need not be reset to adapt the energy control to the new type disc. Further, the stops formed as ratchet tooth gaps 8' (FIG. 2) may also perform a centering function to ensure that the type disc is accurately aligned for printing the selected characters. Also, the centering stops can increase the writing speed, since they shorten the outward swing of the type disc after it is arrested in the desired angular position.

It will be understood that the above description of the present invention is susceptible to various modifications, changes and adaptations, and the same are intended to be comprehended within the meaning and range of equivalents of the appended claims.

What is claimed is:

1. In a typing device having a platen for supporting a record carrier; a type disc including a plurality of bars each carrying a character; the disc being rotatable about an axis through predetermined angles for successively setting selected characters in a printing position; a hammer for impacting the bar of the selected character for pressing the selected character against the record carrier; and drive means for actuating the hammer; the improvement comprising (a) a plurality of stops provided on said type disc; each said stop being assigned to a separate one of said characters; said stops being arranged at least at two different distances from said axis dependent upon the printing surface area of the associated character;

(b) an elastic lever having a first end and a second end and being movable to effect an abutting engagement of said first end with the stop of the associated character situated in the printing positon; and (c) coupling means connecting said second end of said elastic lever to said hammer for simultaneously moving, by said drive means, said hammer towards the bar situated in the printing position and said first end of said elastic lever towards the respective stop; said elastic lever being arranged to absorb, upon engagement with the respective stop, one part of the kinetic energy imparted by said drive means, for reducing the force with which the character is pressed against the record carrier; the magnitude of said one part of the kinetic energy being a function of the distance of the respective stop from said axis.

2. A typing device as defined in claim 1, wherein said elastic lever is pivotally supported and is formed of a first arm having said first end and a second arm having said second end; said coupling means transmitting to said elastic lever any displacement of said hammer towards the bar situated in the printing position; at least one of said arms being structured to undergo a resilient bending deformation during a displacement of said hammer subsequent to the abutting engagement between said first end of said resilient lever and the respective stop.

3. A typing device as defined in claim 1, wherein said drive means for actuating said hammer is an electromagnet including an armature arranged to transmit kinetic energy to said hammer upon energization of said electromagnet and wherein said elastic lever is pivotally supported and is formed of a first arm having said first end, a second arm having said second end and a third arm constituting said armature; said coupling means transmitting to said hammer a displacement of said second arm moved in response to the energization of said electromagnet; at least one of said arms being structured to undergo a resilient bending deformation subsequent to the abutting engagement between said first end of said resilient lever and the respective stop.

4. A typing device as defined in claim 1, wherein said stops are constituted by tooth gaps defined by adjoining ratchet teeth arranged on a hub of said type disc in a circumferential series; the radial depth of each gap being dependent upon the printing surface area of the respective associated character.

5. A typing device as defined in claim 1, wherein said stops are constituted by steps arranged on a hub of said type disc in a circumferential series; the radial depth of each step being dependent upon the printing surface area of the respective associated character.

* * * * *